US007872211B2

(12) United States Patent
Troitski

(10) Patent No.: US 7,872,211 B2
(45) Date of Patent: Jan. 18, 2011

(54) LASER-DYNAMIC SYSTEM FOR USING IN GAMES

(75) Inventor: Igor Troitski, 853 Arrowhead Trail, Henderson, NV (US) 89015

(73) Assignee: Igor Troitski, Henderson, NV (US)

( * ) Notice: Subject to any disclaimer, the term of this patent is extended or adjusted under 35 U.S.C. 154(b) by 1622 days.

(21) Appl. No.: 11/149,375

(22) Filed: Jun. 10, 2005

(65) Prior Publication Data

US 2006/0281560 A1 Dec. 14, 2006

(51) Int. Cl.
*B23K 26/00* (2006.01)
*A63F 7/00* (2006.01)

(52) U.S. Cl. ..... 219/121.85; 219/121.6; 463/50; 463/51

(58) Field of Classification Search ..... 463/49, 463/50, 51, 52, 64; 219/121.6, 121.85; 60/203.1, 60/204

See application file for complete search history.

(56) References Cited

U.S. PATENT DOCUMENTS 3,818,700 A * 6/1974 Kantrowitz et al. ..... 60/203.1
3,851,974 A * 12/1974 Ravussin et al. ..... 356/153
3,941,973 A 3/1976 Luck, Jr. et al.
4,036,012 A * 7/1977 Monsler ..... 60/203.1
4,426,843 A * 1/1984 Fowler et al. ..... 60/203.1
4,734,550 A 3/1988 Imamura et al.
4,941,093 A 7/1990 Marshall et al.
5,152,135 A * 10/1992 Kare ..... 60/203.1
5,178,725 A 1/1993 Takeno et al.
5,786,560 A 7/1998 Tatah et al.
6,465,756 B2 10/2002 Tanaka et al.
6,472,295 B1 * 10/2002 Morris et al. ..... 438/463
6,530,212 B1 * 3/2003 Phipps et al. ..... 60/203.1
6,720,521 B2 4/2004 Troitski
6,727,460 B2 4/2004 Troitski
6,777,645 B2 8/2004 Ehrmann et al.
6,781,092 B2 8/2004 De Steur et al.
2004/0109480 A1 * 6/2004 VanDruff ..... 372/26
2005/0153262 A1 * 7/2005 Kendir ..... 434/21
2006/0175312 A1 * 8/2006 Troitski ..... 219/121.85

FOREIGN PATENT DOCUMENTS

JP 4-166982 A * 6/1992

* cited by examiner

*Primary Examiner*—Geoffrey S Evans

(57) ABSTRACT

Two general effects of laser radiation interaction with balloon surface material or with gases surrounding or filling balloons are used for the play: the destruction and the shift of the inflated balloons. The kind of the laser-material interaction is selected depending on the game structure so that the desirable effect is produced by the minimal laser energy. The energy minimization is provided by the selection of the surface properties, the laser radiation parameters, the characteristics of the gases surrounding and inflating balloons, and the creation of the gas pressure inside the balloons. The desirable effects are generated by absorption of the used laser radiation or by laser-induced breakdown.

17 Claims, 5 Drawing Sheets

LASER-DYNAMIC SYSTEM FOR USING IN GAMES

FIELD OF THE INVENTION

The present invention relates to laser systems which use effects of interaction of laser radiation with light inflated balloons, in particular, for dynamic games.

BACKGROUND OF THE INVENTION

A number of techniques and laser systems which use effects of the laser-material interaction, in particular, for processing materials are well known.

U.S. Pat. No. 3,941,973 to Luck, Jr., et al. reveals an apparatus for laser material removal from a work piece wherein optical means is provided for compressing portions of the beam.

U.S. Pat. No. 4,734,550 to Imamura, et al. discloses a laser processing method comprises the steps of generating a pulsed laser beam having a substantially circular shape and scribing the surface of a work piece with the rectangular beam to form grooves therein.

U.S. Pat. No. 4,941,093 Marshall, et al. discloses laser apparatus for eroding a surface comprises means to select and control the shape and size of the area irradiated by each pulse of laser energy without varying the energy density of the beam.

U.S. Pat. No. 5,178,725 to Takeno, et al. discloses a method for working ceramic material which includes an irradiation process of irradiating a laser beam to the base material in order to form an affected portion having cracks and a removing process for removing the affected portion.

U.S. Pat. No. 5,786,560 to Tatah, et al. proposes a method of treating a material by generating an ultraviolet wavelength laser beam having femtosecond pulses. Apparatus includes a beam splitter for splitting the ultraviolet laser beam into a plurality of separate laser beams; directing the separate laser beams onto a target point within a sample such that the separate beams overlap to create an intensity sufficient to treat the sample.

U.S. Pat. No. 6,465,756 to Tanaka describes a method and apparatus in which a laser beam from a portion softening mechanism of an apparatus is condensed onto a portion on a surface of a work piece for softening the portion.

U.S. Pat. No. 6,472,295 to Morris, et al. describes a method and apparatus for laser cutting a target material. The method includes the steps of generating laser pulses from a laser system and applying the laser pulses to the target material so that the laser pulses cut through the material.

U.S. Pat. No. 6,720,521 to Troitski discloses a method and laser system controlling breakdown process development by creation of special space structure of laser radiation.

U.S. Pat. No. 6,727,460 to Troitski discloses a system for high-speed production of high quality laser-induced damage images inside transparent materials by the combination of an electro-optical deflector and means for moving the article or focusing optical system.

U.S. Pat. No. 6,777,645 to Ehrmann, et al. describes a precision, laser-based method and system for high-speed, sequential processing of material of targets within a field. The system controls the irradiation distribution pattern of imaged spots.

U.S. Pat. No. 6,781,092 to De Steur, et al. discloses a method for drilling holes in a substrate by laser radiation. When holes are being drilled in an electric circuit substrate, a laser beam is moved on concentric circular track in the region of the hole to be drilled.

SUMMARY OF THE INVENTION

The purpose of the present invention is disclosure of a laser-dynamic system which is used for game with the light inflated balloons.

The invention discloses a method for the effect on the inflated balloons by a laser radiation and shows how the effects accompanying laser-material interaction can be used for a play with such balloons. In principal two general effects are used for the play: the destruction and the shift of the inflated balloons. The kind of the laser-material interaction is selected depending on the game structure so that the desirable effect is produced by the minimal laser energy. The minimal laser energy is provided by the selection of the surface properties, the laser radiation parameters, the characteristics of the gases surrounding and inflating balloons, and the creation of the corresponding gas pressure inside the balloons.

The desirable destructive effect on an inflated balloon is produced by the local surface softening, by the local removal of a part of the surface material, and by the pressure created by the strong shock waves generated as a result of the laser-material interaction. These effects are generated by the absorption of the used laser radiation or by the laser-induced breakdown. The destructive effect is produced by the breakdown, a distance of which from the surface balloon is smaller than the critical value and the shift effect is produced by the breakdown generated on a distance from the surface balloon which is larger than the said critical value.

One or more embodiments of the invention comprise a dynamic-laser system for using in games with inflated balloons, comprising: playing room with one or several light inflated balloons; an apparatus for creating gas conditions inside the room; a gas control system; a laser system; a beam delivery system; a control system for players; a computer control system.

Another embodiment of the invention comprises a method for using a dynamic-laser system for playing with the inflated balloons, comprising: determination of the game goal; determination of the game model and structure for the used kind of the laser-material interaction; determination of the rules of the play for the used laser radiation; determination of the play prizes and penalties; controlling the laser radiation; controlling the gas systems.

The invention discloses how the structure, rules and goals of a game with inflated balloons are determined by the laser-material interaction effects which are used in the game.

DETAILED DESCRIPTION OF THE INVENTION

Figure 1:
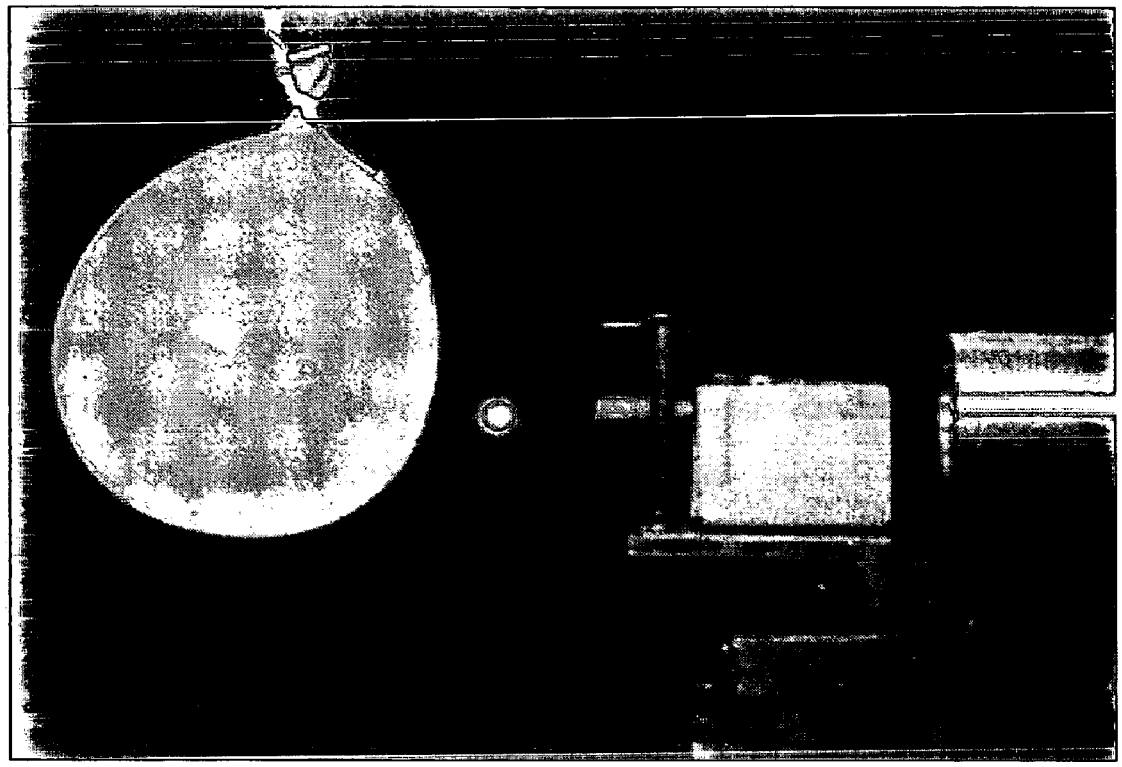
FIG. 1 shows a photo of an air breakdown spark produced by Nd:YAG laser radiation focused at the point which is not far from an inflated balloon. The distance between the breakdown spark and the inflated balloon is larger than the critical value for balloon destruction.

The invention comprises a method and laser-dynamic system for playing with inflated balloons.

The principal concepts of the invention are based on the generation and control of the physical processes accompanying the interaction of the laser radiation with the opaque and transparent material. Effects created by the interaction are used for playing with the inflated balloons. In particularly, two interaction effects are used for this purpose: the destruction of the inflated balloons and their shift.

When laser radiation strikes an inflated balloon of an opaque (or partly opaque) surface, part of the radiation is absorbed and another part is reflected. The absorbed radiation heats the surface. The heating effects due to absorption of the high-power beams can occur very rapidly and the area of the surface, where laser radiation is focused, quickly rises to its melting temperature. If the laser pulse duration is very short then melting occurs without vaporization and laser interaction occurs only with thin layer of the surface. Stretching the pulse length, it is possible to vaporize the part of the material and to melt the thicker layer.

From the point of view of inflated balloon destruction, it is important that heating, melting and vaporization effects soften a surface of an inflated balloon. The pressure of the internal gas is higher than the external gas and the balloon surface is very thin, therefore even minor softening of the surface leads to the balloon destruction.

When laser radiation strikes an inflated balloon of a transparent surface, no part of the radiation is absorbed and laser-induced breakdown becomes the general physical phenomena providing the interaction effects. In principle, the breakdown can be generated on the opaque or transparent surfaces, inside the transparent surfaces and inside the gases surrounding or inflating the balloons, when the laser energy increases the breakdown threshold corresponding to the medium at which the breakdown is generated. As a result of a laser-induced breakdown, a bright spark (hot plasma) is arisen. The hot plasma produces two effects: the first is the heating of the surface material that can destruct an inflated balloon, and the second is the creation of the high pressure. The second effect can be used for both the destruction and shift of an inflated balloon. If a breakdown is created nearer than the critical distance then the inflated balloon is destroyed; if a breakdown is generated farther than the critical distance (but not very far from the balloon surface) then the balloon is woved.

So the destruction of the opaque balloon surface can be produced by using two physical phenomena: the absorption of the laser radiation or the laser-induced breakdown. The destruction of the transparent balloon surface cannot be produced by the absorption and is produced by the laser-induced breakdown. In both cases, the balloon destruction is a result of the softening of the balloon surface. Softening opaque and transparent surfaces is produced by the local heating, the local melting, and the local removal of a part of the surface material. The local removal of a part of the surface material is produced by the local vaporization of the material, the joint action of melting and vaporization so that part of the material is removed as liquid and the part of the material is removed as vapor. The destruction of a balloon surface is also produced by the local pressure created by the strong shock waves generated as a result of laser-material interaction. These shock waves are generated by laser-induced breakdown produced inside the gases surrounding or inflating the balloons.

Figure 2:
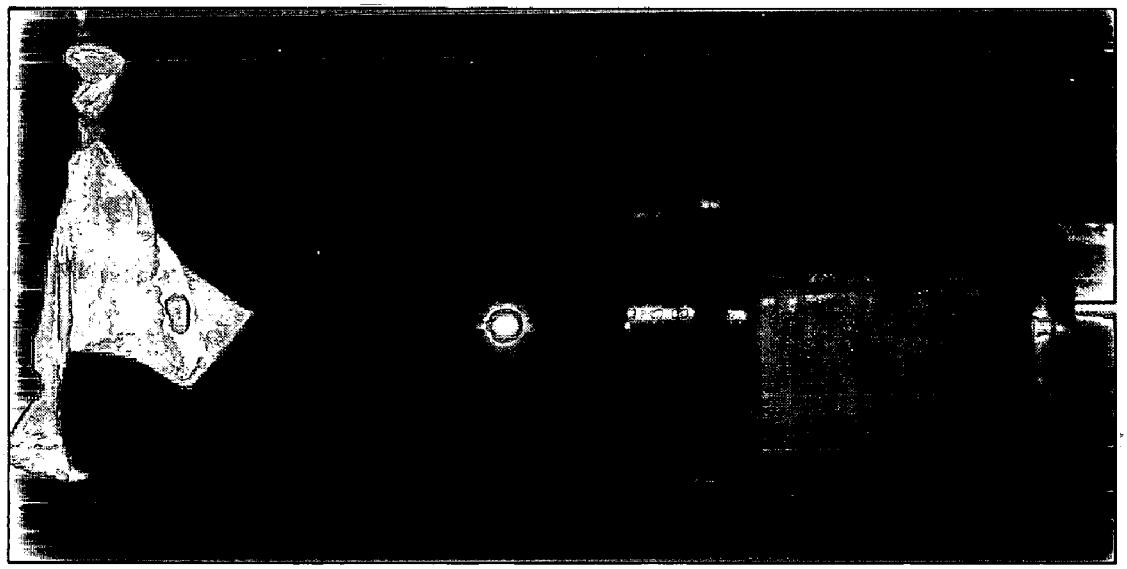
FIG. 2 shows a photo of a balloon remains after a laser-induced breakdown; the distance between the breakdown point and the balloon surface is smaller than the critical value.

FIG. 1 shows a photo of an air breakdown spark produced by Nd:YAG laser radiation focused at the point which is not far from a surface of inflated balloon. The distance between the breakdown spark and the inflated balloon is larger than the critical value for balloon destruction. FIG. 2 shows a photo of a balloon remains after laser-induced breakdown; the distance between the breakdown point and the balloon surface is smaller than the critical value.

The selection of physical effect (absorption or laser-induced breakdown), which is reasonable to use for the balloon burst, is made depending on the game structure and so that the desirable effect is produced by the minimal laser energy. In its turn, the minimal laser energy is provided by selection of the balloon surface properties and the characteristics of the gases surrounding and inflating the balloons. If absorption effect is used then the surface cover and wavelength of laser radiation are selected so that the absorption coefficient of the surface for this laser radiation has maximum value. If the breakdown is used then the surface material or gases surrounding and inflating the balloons (depending on where breakdown is produced) and the laser radiation parameters are selected so that the breakdown threshold has minimal value. The gas pressure within an inflated balloon is selected so that the destruction of the balloon is produced by a laser radiation of minimal energy.

Figure 3:
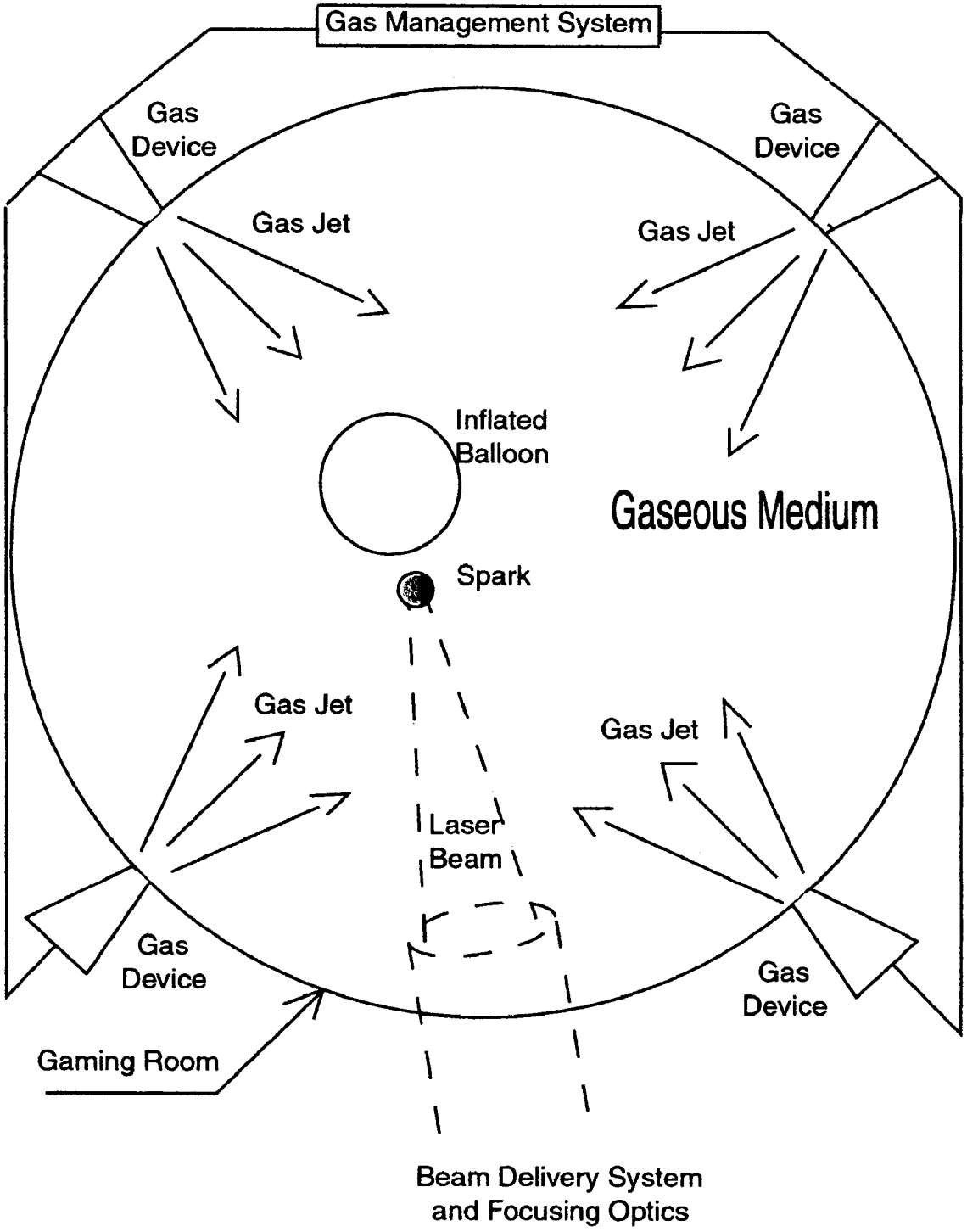
FIG. 3 illustrates a method for using a dynamic laser system for playing with inflated balloons in case when the game goal is the balloon destruction. A gaming room with gaseous medium contains: an inflated balloon and devices generating gas jets, which are controlled by a gas management system. A beam delivery system and focusing optics focus laser beam at the point, where laser-induced breakdown creates a spark.

The location of the laser-material interaction area is very essential for production of the desirable effect. In case of using the absorption effect, the laser-material interaction is the balloon surface or its small part. In case of using the laser-induced breakdown effect, the breakdown is produced on the surface or inside the surface material, inside gasses surrounding or inflated balloons. The concrete place is determined by the structure of game. For destruction of a balloon of an opaque surface, a laser-induced breakdown is produced on the surface or inside surrounding gases within "firing range" (FIG. 3). For destruction of a balloon of a transparent surface, a laser-induced breakdown is produced on the surface or inside the surface material or inside surrounding gases or inflating gases within "firing range". "Firing range" or the critical distance is the maximum distance from a balloon surface when the destruction of the balloon by a breakdown spark is else arisen. For a balloon shift the distance between breakdown area and a balloon surface increases the critical value, but not very significantly, because the shift effect is inversely proportional to the distance. From the point of view of a balloon game, a player has complicated situation because desiring to produce the maximum shift he risks to burst an inflated balloon.

Material of balloon surface is determined depending on a game: if a game goal is to burst an inflated balloon then the material is selected so that the balloon surface has maximal absorption coefficient, if a goal game is to move an inflated balloon then the material is selected so that the balloon surface has minimal absorption coefficient and maximal elasticity coefficient.

Figure 4:
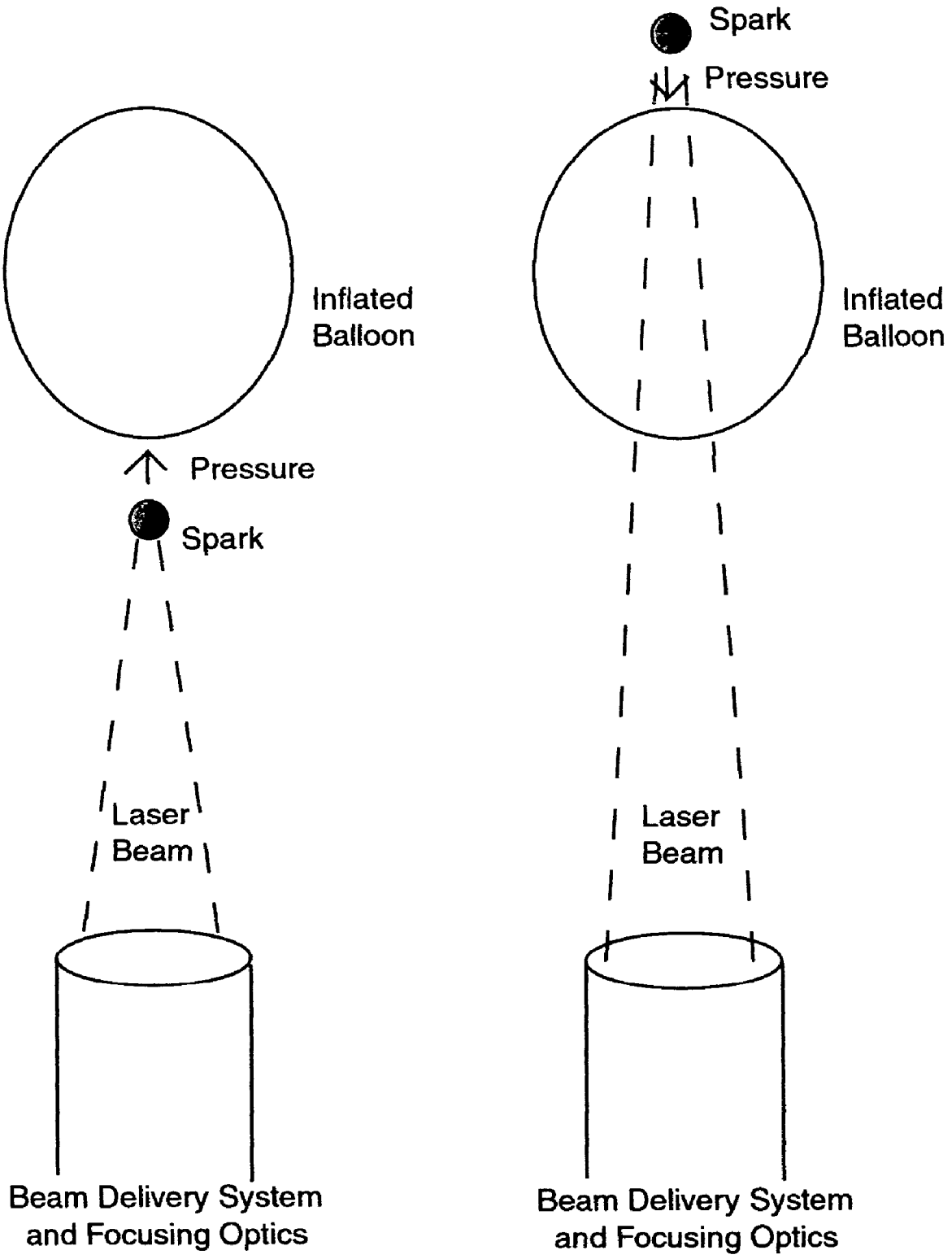
FIG. 4 shows the direction of shock wave action on an inflated balloon with transparent cover depending on the location of a breakdown point: a spark before the balloon creates a shock wave, which removes the balloon; a spark behind the balloon creates a shock wave, which approaches the balloon.

The location of the breakdown area determines the direction of the balloon movement. For example, if a player wishes to move a balloon to the right he should produce the breakdown from the left side of the balloon. FIG. 4 shows the direction of a shock wave action on an inflated balloon with a transparent cover depending on a location of a breakdown point: a spark located before the balloon creates a shock wave, which removes the balloon; a spark located behind the balloon creates a shock wave, which approaches the balloon.

A speed which a balloon has as a result of the breakdown depends on the energy of the laser radiation generating the gas breakdown. The larger energy provides greater speed. The effect of the laser actions is increased by repetition of the breakdowns at the same point. The additional number of the breakdowns generated at the same point or at the neighbor points increases the laser-material interaction effect. The control of the laser-material interaction effect is produced by the control of the breakdown sparks sizes, sparks brightness and the number of the breakdowns.

Control of the breakdown location is produced so that the laser energy increases the breakdown threshold at the predetermined area only. For example, this area is the focal area of the used laser beam. Another method is based on the using several beams. If the energy of each beam is below the breakdown threshold and their total energy increases the breakdown threshold, then a breakdown is generated only at the area of their intersection.

One or more embodiments of the invention comprise a method for the effect on the inflated balloons by a laser, comprising:

- determination of the action which a laser radiation produces on an inflated balloon;
- selection of the kind of laser-material interaction demanded for the production of the predetermined action;
- determination of the laser parameters needed for the generation of the predetermined kind of the laser-material interaction;
- selection of the area of the laser-material interaction;
- generation of the laser radiation of the predetermined parameters;
- direction of the laser radiation at the predetermined laser-material interaction areas;
- creation of gas pressure inside the balloon for making easier the effect of laser-material interaction;
- generation of the selected laser-material interaction at the predetermined areas for the production of the desirable laser-material interaction effect.

A structure of a game with inflated balloon by using the laser radiation is determined by those opportunities, which the laser-material interaction gives. A game can be based only on the destruction effect. In this case, the game goal is to burst an inflated balloon as soon as possible. If a balloon has an opaque surface and the absorption effect is used then it is necessary to direct laser radiation on the balloon. The speed of the destruction is inverse proportional to the sizes of the focal spot. If destruction of a balloon is produced by the breakdown then it is necessary to generate sparks near the balloon. Destruction of a balloon by only one spark is produced if a player creates breakdown closer than the critical distance. A player can creates the breakdown by focusing the laser beam at the desirable area or by the intersection of several laser beams at the area. The breakdown sparks are visible, but they can be created by both visible and invisible laser radiation. In the last case, a player can use the cut-and-try method. However, it is possible to use additional low power visible laser beam, direction of which coincides with the general laser beam.

To complicate the game task it is reasonable to use special gas devices which generate the gas flows. These gas flows are directed to the balloon, which a player should burst, in accordance with a random algorithm or directions of the gas flows can be controlled by the second player, who plays against the first player.

Figure 5:
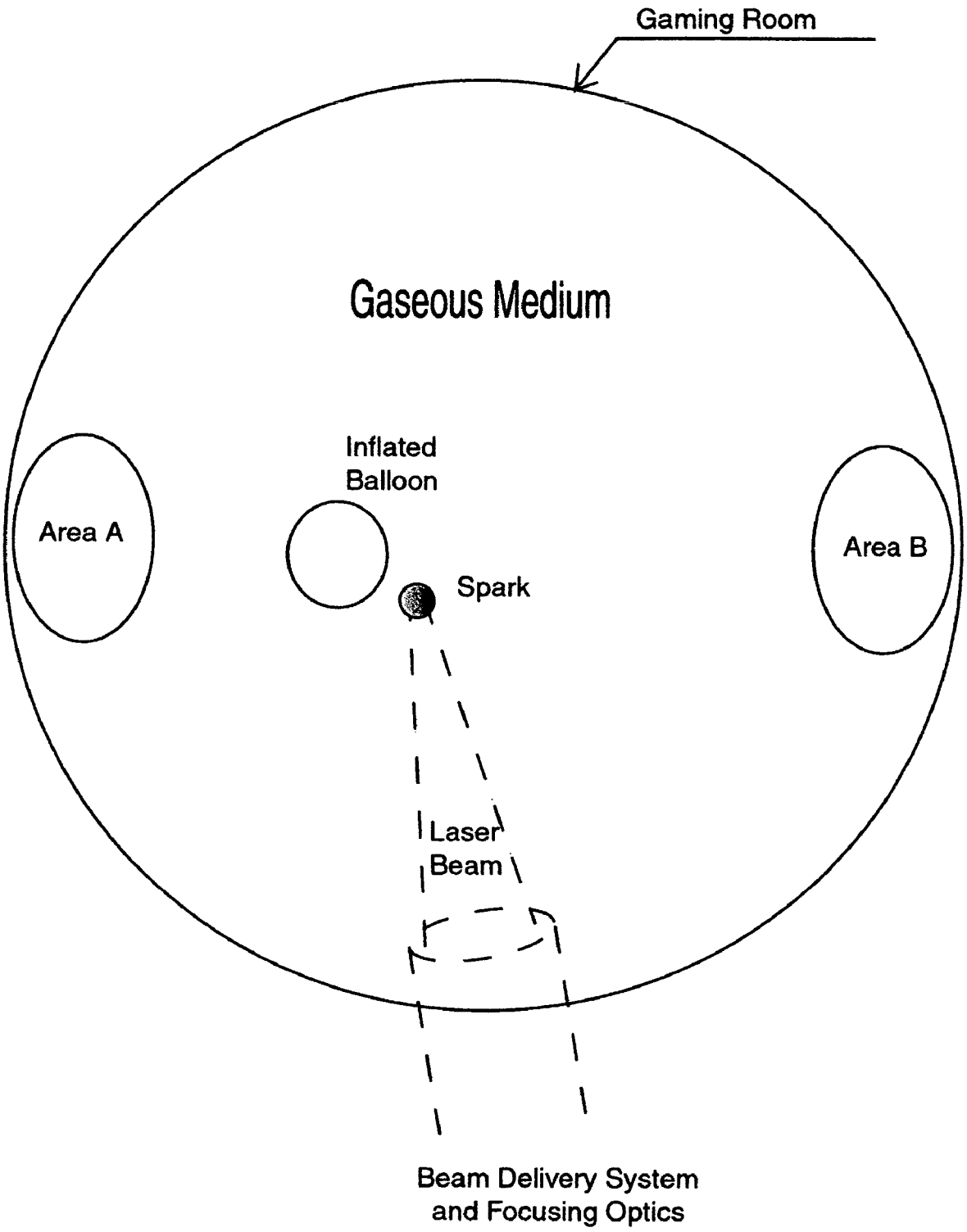
FIG. 5 illustrates a method for using a dynamic laser system for playing with inflated balloons, when the game goal is to set them in motion. A gaming room with gaseous medium contains: an inflated balloon, area A to which a player A should remove the balloon and area B to which a player B should remove the balloon. Both players use the beam delivery system and focusing optics to focus the laser beam at the desirable point for creation of a laser-induced breakdown. A spark, shown in this Figure is created by player A to move the balloon towards area A.

An example of a play with balloon and corresponding laser-dynamic system are illustrated by FIG. 3. This figure illustrates a case when the laser-dynamic system is used for the play based on the destruction of an inflated balloon by a laser-induced breakdown. A gaming room with gaseous medium contains: an inflated balloon and devices generating gas jets, which are controlled by a gas management system. The control can be produced by automatically (for example, in a random way), or by a player. A beam delivery system and focusing optics are used by another player to focus laser beam at the point near the balloon surface, where laser-induced breakdown creates a spark. In the general case, the system can comprise several beam delivery systems, and several inflated balloons can be located at the gaming room. FIG. 5 illustrates a laser-dynamic system used for playing with inflated balloons in case of their shift. A gaming room with gaseous medium contains: an inflated balloon, area A to which a player A should locate the balloon and area B to which a player B should locate the balloon. Both players use the beam delivery system and focusing optics to focus the laser beam at the desirable point near the balloon surface for the creation of a laser-induced breakdown. A spark, shown in this Figure and created by player A, moves the balloon towards area A. In the general case, the system can comprise several beam delivery systems, and several devices generating gas jets.

One or more embodiments of the invention comprise a dynamic-laser system for using in games with inflated balloons, comprising: a playing room with one or several light inflated balloons; an apparatus for creating gas conditions inside the room; a gas control system; a laser system; a beam delivery system; a control system for players; a computer control system.

Figure 6:
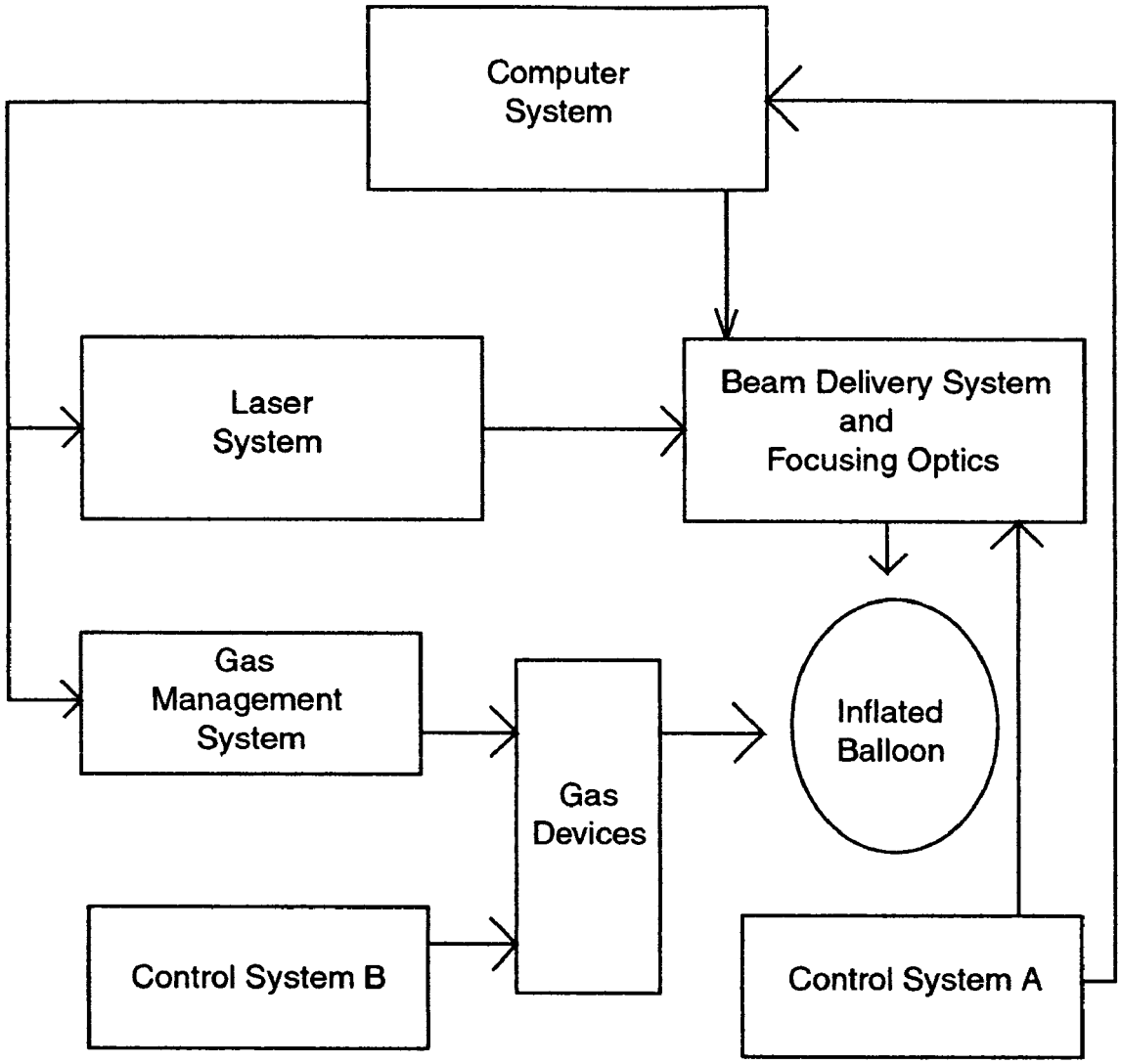
FIG. 6 illustrates in block-diagram form a laser-dynamic system for using in a play with inflated balloons placed inside gaseous medium. Computer system controls a laser system, a beam delivery system, focusing optics, and a gas management system. A laser system generates the pulse radiation which is capable to destroy an inflated balloon or to move it. Beam delivery system and focusing optics direct and focus the laser radiation at the desirable point of the gaming room. Gas devises generate the gas jets. A gas management system controls the gas jets inside a gaseous medium. Control system A is used by a player for controlling breakdown points. Control system B is used by a player for controlling the power and the directions of the gas jets.

FIG. 6 illustrates in block-diagram form a laser-dynamic system for using in a play with inflated balloons placed inside gaseous medium. A computer system controls a laser system, a beam delivery system, focusing optics, and a gas management system. A laser system generates the pulse radiation which is capable to destroy an inflated balloon or to move it. Beam delivery system and focusing optics direct and focus the laser radiation at the desirable point of the gaming room. Gas devises generate gas jets. A gas management system controls gas jets inside a gaseous medium. A control system A is used by a player for controlling the breakdown points. A control system B is used by a player for controlling the power and the directions of gas jets.

One or more embodiments of the invention comprise a method for using dynamic-laser system for playing with the inflated balloons, comprising:

determination of the game goal;

determination of the game model and structure for the selected kind of laser-material interaction;

determination of the rules of the play for the used laser radiation;

determination of the playing prizes and penalties;

controlling the laser radiation;

controlling the gas systems.

The game goal can be the distortion of one or several inflated balloons or shift of such balloons at the demanded locations. A model and a structure of the games are determined depending on the game goal, the kind of the selected laser-material interaction, the kind of the beam delivery, the kind of the control of the gas systems, the kind of the laser radiation and the kind of the localization of the laser radiation. For example, the game goal is the distortion of an inflated balloon; the selected laser-material interaction is generated by the laser-induced breakdown; the control of the gas system is produced automatically in a random way; the beam delivery is controlled by a player; used laser radiation is invisible for naked eye and the localization of the laser radiation is produced by focusing the radiation at the desirable area. In this case, a model and a structure of a game can be constructed by the following way: one player should destroy the predetermined inflated balloon, which moves in a random way due to the gas flows; the player does not see the laser radiation and see laser-induced sparks only; the gaming room contains several other inflated balloon, which move chaotically and can hide the predetermined balloon. The rule of the play prohibits the destruction of a balloon which is not predetermined. The player gets a penalty if he destroys another balloon. His prize is inverse proportional to the number of laser pulses which he used for the destruction of the predetermined balloon. A structure of a game is changed if two players take part in the game. For example, gas flows are controlled by the second player who controls the gas system so that to prevent from the destruction of the predetermined balloon. The game model is also changed if the used laser radiation is visible or if using additional visible radiation. This additional radiation has low energy and its direction coincides with the direction of the general invisible laser beam. Also game structure depends on the way of the creation of the breakdown area. If the area is created by focusing the used laser radiation then a player use only one beam delivery system combined with a focusing system. If the breakdown area is created by the intersection of several laser beams then a player controls several beam delivery systems. A game model can combine destructive effect and shift of inflated balloons so that a game structure forms the game goal and game prizes depending on the result of both effects. For example, destruction of the predetermined balloon can be produced only at the predetermined area at which the balloon should be shifted.

I claim:

1. A method of playing games comprising:

determining an action that a laser material interaction produces on at least one inflated balloon;

selecting a laser material interaction depending upon said action;

determining laser beam parameters that are required for generation of the laser material interaction;

selecting at least one area in a space for laser material interaction;

generating a laser beam with said laser beam parameters required for laser material interaction;

wherein the laser material interaction is selected depending on a game structure, and the action of the laser material interaction is destruction of the at least one inflated balloon or shift of the at least one inflated balloon.

2. A method in accordance with claim 1 wherein the desirable destructive effect on an at least one inflated balloon of an opaque surface is produced as a result of the absorption of the incident laser radiation.

3. A method in accordance with claim 1 wherein, the required laser energy is minimized by selecting of surface material of the at least one inflated balloon and the laser radiation parameters.

4. A method in accordance with claim 1 wherein, the required laser energy is minimized by the selecting of a composition of the gases surrounding and filling the at least one balloon and by the creation of the gas pressure inside the at least one balloon.

5. A method in accordance with claim 1 wherein the desirable destructive effect on an at least one inflated balloon is produced by local surface softening created as a result of the laser-material interaction.

6. A method in accordance with claim 1 wherein the desirable destructive effect on an at least one inflated balloon is produced by the local removal of a part of the surface material which is a result of the laser-material interaction.

7. A method in accordance with claim 1 wherein the desirable destructive effect or the desirable shift of an at least one inflated balloon are produced by the pressure created by strong shock waves generated as a result of laser-material interaction.

8. A method in accordance with claim 1 wherein the desirable destructive effect or the desirable shift of an at least one inflated balloon are produced by the effects accompanying the gas breakdown generated by the laser radiation.

9. A method in accordance with claim 8 wherein a speed of an at least one inflated balloon is influenced by the energy of the laser radiation generating the gas breakdown.

10. A method in accordance with claim 8 wherein the desirable destructive effect or the desirable shift of an at least one inflated balloon are determined by the distance between a breakdown points and a surface of at least one balloon so that the distance for the destructive effect is smaller than the critical value; the distance for the shift effect is larger than the said critical value.

11. A method in accordance with claim 10 wherein the location of the breakdown area determines the direction of the movement of the at least one balloon.

12. A dynamic-laser system for using in games with inflated balloons, comprising:

a playing room with at least one light inflated balloons;

an apparatus for creating gas conditions inside the room comprising: gas devises generating gas flows for stochastic moving said at least one balloon and means for creation of gas composition reducing the breakdown threshold;

a gas control system controlling direction and flux level of the said gas flows;

a laser system for generating laser radiation which is capable of destroying the the at least one inflated balloon or to move the at least one inflated balloon;

a beam delivery system for directing and focusing the laser radiation at any desirable point of the playing room;

a control system for players so that the players can control the power and direction of the gas flows and can create laser-induced breakdowns at selected areas in the playing room;

a computer control system for controlling game rules corresponding to a selected game structure and for controlling the laser system, the gas management system, the beam delivery system and focusing optics.

13. The system of claim 12 wherein the laser system generates at least two laser beams that intersect at the desirable room areas to cause laser induced breakdown.

14. A method for using dynamic-laser system for playing with the at least one inflated balloon, comprising:

determining a game model in accordance with physical effects created by laser radiation during its interaction with the at least one inflated balloon;

determining a game structure for the selected kind of the laser-material interaction;

determining a game goal depending upon laser beam parameters;

determining the rules of play;

determining playing prizes;

controlling the laser radiation;

controlling gas systems creating gas jets inside a playing room.

15. A method in accordance with claim 14 wherein the game goal is distortion of the inflated balloon by the effects accompanying the laser-material interaction.

16. A method in accordance with claim 14 wherein the game goal is the shift of inflated balloons at a desirable location by the effects accompanying the laser-material interaction.

17. A method in accordance with claim 14 wherein the game goal combines distortion and movement of the predetermined inflated balloon by the effects accompanying the laser-material interaction.

* * * * *